US006276810B1

(12) United States Patent
Vosshenrich

(10) Patent No.: US 6,276,810 B1
(45) Date of Patent: Aug. 21, 2001

(54) RACK LAMP

(75) Inventor: Udo Vosshenrich, Bad Salzuflen (DE)

(73) Assignee: decor metall GmbH + Co. KG, Benzstrasse (DE)

( * ) Notice: Subject to any disclaimer, the term of this patent is extended or adjusted under 35 U.S.C. 154(b) by 0 days.

(21) Appl. No.: 09/423,048

(22) PCT Filed: Apr. 24, 1998

(86) PCT No.: PCT/EP98/02487

§ 371 Date: Nov. 1, 1999

§ 102(e) Date: Nov. 1, 1999

(87) PCT Pub. No.: WO98/49490

PCT Pub. Date: Nov. 5, 1998

(30) Foreign Application Priority Data

Apr. 30, 1997 (DE) ..... 197 18 486

(51) Int. Cl.[7] ..... F21W 131/301; F21W 131/405
(52) U.S. Cl. ..... 362/127; 362/125; 362/812
(58) Field of Search ..... 362/253, 127, 362/125, 133, 812

(56) References Cited

U.S. PATENT DOCUMENTS 4,689,736 * 8/1987 Kretzschmar ..... 362/127
5,040,101 * 8/1991 Aspenwall ..... 362/125
5,359,503 * 10/1994 Myodo et al. ..... 362/127
5,530,628 * 6/1996 Ngai ..... 362/127 X
6,129,441 * 10/2000 Wu et al. ..... 362/127

FOREIGN PATENT DOCUMENTS 43 22 934 1/1995 (DE) .
0 441 354 8/1991 (EP) .
2 710 510 4/1995 (FR) .
1136188 12/1968 (GB) .

* cited by examiner

*Primary Examiner*—Laura K. Tso
(74) *Attorney, Agent, or Firm*—Browdy and Neimark

(57) ABSTRACT

Disclosed is a lamp for a display stand or a rack, to be secured to a shelf and designed as an adaptable lamp to be removably hung at the shelving edge (3) and to project light beams (LS) on the shelf front face and the lower part of the display rack (3). The inventive adaptable lamp resembles a light channel to be fitted into a U-shaped moulding in the rack front face (3) in such a way that it occupies the whole width of the light channel, in which both the lamp casing and the lamp itself, preferably a set of fluorescent lamps, are incorporated. The light channel (LK) profile (7) is designed so that the channel can house the lamp casing in a fixed position (5), and that the front and lower profile area (8, 9) can let the light beams (LS) through.

6 Claims, 1 Drawing Sheet

RACK LAMP

CROSS REFERENCE TO RELATED APPLICATION

The present application is the national stage under 35 U.S.C. 371 of PCT/EP98/02487, filed Apr. 24, 1998.

BACKGROUND OF THE INVENTION

1. Technical Field of the Invention

The present invention relates to a lighting fixture for/on a display stand for articles of merchandise to illuminate each level of shelving.

2. Prior Art

A lighting fixture for display stands has become known, for example, from DE 295 15 221 U1, in which the display stand lighting fixture is firmly integrated into each level of shelving to illuminate the merchandise placed on the shelves. To achieve this effect, the lateral support arms for the display shelves are extended towards the front, and extended at their ends, at a distance from the front edge of the shelf, by a cross-profile inside which illumination means are housed.

For this type of lighting each level of shelving, i.e., each individual shelf panel must, therefore, be specially equipped, which results in a complex and expensive construction and does not permit retroactive mounting or retrofitting of the lighting.

From GB-PS 1 136 188 an adaptable lighting fixture has furthermore become known. In this adaptable lighting fixture the light channel profile is formed by a closed, hollow holder, which is secured to a bracket by means of a connecting strip and/or a hook, houses a lighting fixture mounting strip in its interior and carries a lamp on its outside.

The fastening method in the above design is complex and also not very easy to implement with the shelving used in display stands for articles of merchandise.

Furthermore, no specific illumination of the front and the next lower level of shelving is achieved, instead light is projected onto individual areas.

Furthermore, this known lighting fixture, due to its lack of a profile area, does not permit an advantageous affixing of price indicator labels, etc.

OBJECT AND SUMMARY OF THE INVENTION

It is the object of the present invention to create a lighting fixture with a simple and inexpensive design, which can be easily, securely and removably fastened to the front edge of the shelving levels of the display stand for articles of merchandise and has advantageous illumination areas for the shelf below and towards the front of the display stand in such a way that this lighting does not require any special arrangements at the level of shelving to illuminate same.

This object is met according to the invention with the light channel profile having on its back side a hook-on type ledge fitted into a U-shaped mold of the display shelf which, together with the back panel of the light channel profile, forms a holding and position-fixing clamp for the adaptable lighting fixture that hooks over the unattached upright web of the mold, and incorporates at its front and underside a profile area that allows the light beams through.

The inventive lighting is advantageously designed as an adaptable lighting fixture, which can be secured, without special arrangements at the display shelf, directly to the front edge of the shelf, which may be done either during manufacturing of the display stand or as a retrofit part.

The display shelves each have at their front edge along the width of the display stand a U-shaped mold into which the adaptable lighting fixture is removably hung as a light channel that extends along the entire width of the display shelf. The light channel is thus located immediately at the front edge of the display shelf, and this light channel is provided with a transparent or see-through area that illuminates the next lower display shelf, i.e., at least the front area of the merchandise placed on the next lower display shelf, and also projects light beams toward the front of the display stand so that a relatively large illuminated area is created at the front and below. The light channel is made of an advantageously designed plastic profile, inside which the actual lamp casing in the shape of a rectangular tube is held by simple means, with the rectangular tube housing in its interior the electrical lighting fixture components and holding exchangeably inside sockets on its underside the lamp, especially a fluorescent lamp.

At the same time, this adaptable lighting fixture also permits a product advertising and merchandising by illuminating the lower display shelves and has, based on its design and its function, gained an increased usefulness, particularly in view of fact that it is arranged in front of the actual display shelf and forms a separate modular unit.

BRIEF DESCRIPTION OF THE DRAWINGS

An illustrative embodiment of the invention, which will be explained in detail below, is shown in the drawings, in which.

DETAILED DESCRIPTION OF THE PREFERRED EMBODIMENTS OF THE INVENTION

Figure 2:
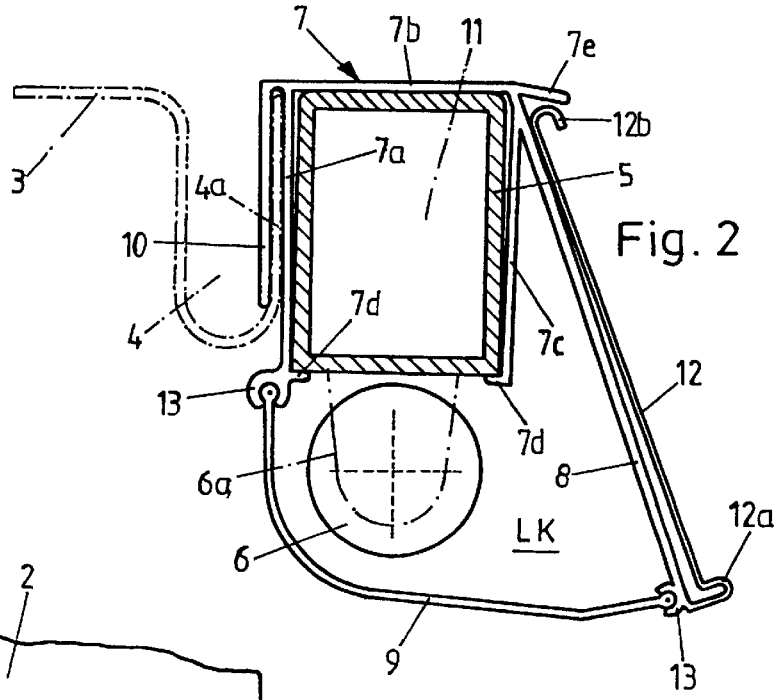
FIG. 2 is a cross section through the adaptable lighting fixture and its removable holder at the display shelf.
Figure 1:
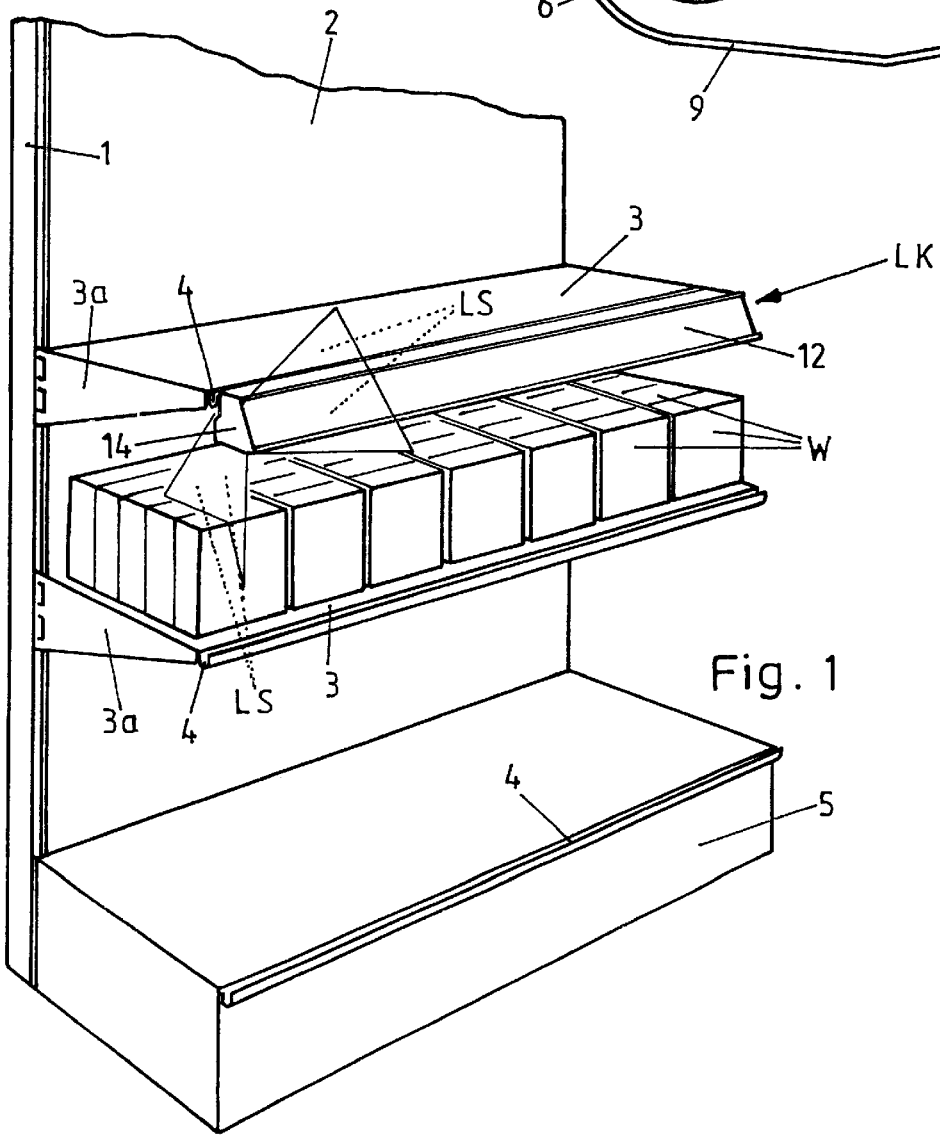
FIG. 1 shows a display stand for articles of merchandise in the perspective with tiered levels of shelving, each illuminated by an adaptable lighting fixture (an adaptable lighting fixture is drawn only at one level of shelving)

The display stand for articles of merchandise (W) of various kinds incorporates two upright supports (1), one on each side, and between them a back wall (2) and a plurality of tiered levels of shelving hung as display shelves (shelf panels) (3) with side consoles **(3*a*) in slits provided in the supports (1). The display stand may furthermore have a base (5)** to be used as a space for placing and storing merchandise (W).

The lighting fixture for/on a display stand for articles of merchandise of this type is provided for each level of shelving (3) and designed in the form of an adaptable lighting fixture to be removably hung at the front edge of the display shelf (3) at the respective level of shelving, projecting light beams (LS) onto the shelf front face and the next lower shelf (3).

The adaptable lighting fixture incorporates a light channel (LK) to be fitted into a U-shaped mold (4) at the front of the display shelf (3) and extending along the entire width of the display shelf and housing in its interior the lamp casing (5) with a lamp (6), preferably a fluorescent lamp. The U-shaped mold (4) is formed integrally directly onto the front edge of the display shelf (sheet metal shelf panel) (3), forming the front edge of the display shelf.

This light channel (LK) incorporates a profile (7), which houses the lamp casing (5) in a fixed position and has a front and bottom profile area (8, 9) that allows the light beams (LS) through.

The light channel profile (7) has, on its back side, a hook-on type ledge (10) fitted into the U-shaped mold (4) of the display shelf (3) which, together with the back panel (7*a*) of the light channel profile (7), forms a holding and position-fixing clamp for the adaptable lighting fixture that hooks over the unattached upright web (4*a*) of the mold, through which clamp the adaptable lighting fixture is held in a secure position both with respect to its elevation, as well as to the front and back.

The light channel profile (7) houses, inside a U-shaped or C-shaped chamber (11) with square profile and open bottom, the lamp casing (5) in a fixed position, either in a plug-in or slide-in type connection. The lamp casing (5) is designed as a rectangular tube with square or rectangular shape and made of metal, preferably light metal. The lamp casing (5) may also be an extruded plastic profile. The chamber (11) of the light channel profile (7) is formed by the back panel (7*a*), a covering panel (7*b*), a front panel (7*c*) extending parallel to the back panel (7*a*), and supporting webs (7*d*) projecting towards one another at the lower ends of the front and back panel (7*a*, 7*c*) in such a manner that the inserted lamp casing (5) is encompassed by the profile (7) on three sides and supported from underneath by the supporting webs (7*d*).

The light channel profile (7) has on its front side a transparent or see-through cover (8) sloping towards the front and downward beyond the lamp casing (5) and the flourescent lamp, (6) with a fold-out sign holder strip (12), which is hinged at its lower end by means of a same-material hinge (12*a*) to the cover (8) and has its upper end an integral handle strip (12*b*). The sign holder strip rest against the outside of the cover (8), and behind this sign holder strip (12), ie., between the cover (8) and the sign holder strip (12) advertising graphics, slides, price labels, etc. are exchangeably inserted.

The handle strip (12*b*) on top is overlapped towards the front by a canopy strip (7*e*), which is an integral part of the light channel profile (7).

On the light channel profile (7) and the cover (8), a transparent or see-through bottom cover (9) with arc-shaped cross section, which encompasses the fluorescent lamp (6) at a distance from the lamp, is removably held inside snap-in or plug-type receptacles (13).

The lamp casing (5) houses the electrical components, such as ballast, starter, lead-in connection, cabling and the like in its interior, and exchangeably holds on its underside, in external sockets (6*a*), the fluorescent lamp (6).

The U-shaped mold (4) and hook-on type ledge (10) of the light channel (LK) extend along the entire width of the display shelf, and the light channel (LK) has at both short sides a side shield (14) to close off the sides towards the front.

What is claimed is:

1. A lighting fixture for a display and sales rack to be removable fixed as an attachment light on a face of a display shelf (3) of a level of shelving in such a way that light beams illuminate a front face of a shelf and a next lower display shelf, wherein the lighting fixture comprises, a light channel profile (7) housing a lamp casing (5) with a fluorescent tube (6), the light channel profile (7) having a profile area that allows light beams through on a front and also a cover (8) inclined over the lamp casing (5) and the fluorescent tube (6), said cover having a fold-out viewing strip (12) and an arc-shaped transparent openable bottom cover (9) encompassing the fluorescent tube at a distance engaged between the light channel profile (7) and the cover (8), wherein, the cover (8) and viewing strip (12) are made from a same transparent material and are engaged together as a unit at a bottom edge of each to form a same material hinge made from the transparent material, and wherein the viewing strip (12) has an integral handle (12*b*) at a top edge thereof.

2. A lighting fixture according to claim 1, wherein the light channel profile (7) houses the lamp casing (5), and has a rectangular tube shape which is made of metal, fixed inside a chamber (11) with a C-shaped cross-section and open at a bottom.

3. A lighting fixture according claim 1, wherein the light channel profile (7) has, opposite the cover (8), a holding clamp (10) opening downward.

4. A lighting fixture according to claim 1, wherein the transparent bottom cover (9) is removably engaged on the light channel profile (7) and the cover (8) which each have snap-in receptacles (13) to engage cover (9).

5. A lighting fixture according to claim 1, wherein lamp casing (5) houses and exchangeably holds on an underside the fluorescent lamp (6) in external sockets (6*a*).

6. A lighting fixture according to claim 1, wherein the holding clamp (10) extends along an entire width of the display shelf, and the light channel profile (7) has a side shield (14) at each end closing the end towards the front.

* * * * *